United States Patent [19]

Roberts, IV

[11] 3,982,473

[45] Sept. 28, 1976

[54] ENVELOPE-MAKING METHOD

[75] Inventor: John Roberts, IV, East Liverpool, Ohio

[73] Assignee: American Paper Products Company, Youngstown, Ohio

[22] Filed: June 26, 1975

[21] Appl. No.: 590,581

[52] U.S. Cl. ..... 93/63 M; 93/61 R

[51] Int. Cl.[2] ..... B31B 1/16

[58] Field of Search ..... 93/63 M, 63 R, 62, 61 R, 93/13, 35 R; 229/68 R, 69

[56] References Cited

UNITED STATES PATENTS

| | | | |
|---|---|---|---|
| 1,070,341 | 8/1913 | Hepp | 93/13 |
| 2,903,947 | 9/1959 | Weisshuhn | 93/13 X |
| 3,344,719 | 10/1967 | Weisshuhn | 93/63 M |
| 3,626,821 | 12/1971 | Gendron | 93/63 M |

FOREIGN PATENTS OR APPLICATIONS

| | | | |
|---|---|---|---|
| 588,193 | 12/1959 | Canada | 93/63 R |
| 1,091,495 | 4/1955 | France | 93/63 R |

*Primary Examiner*—James F. Coan
*Attorney, Agent, or Firm*—Brown, Murray, Flick & Peckham

[57] ABSTRACT

A method for making envelope blanks from a continuous web of paper such that the cut blanks can move essentially continuously from one or more cutting stations to envelope-gumming and folding stations. The invention is characterized in cutting two or more side-by-side envelope blanks from the web with a minimum of scrap. This is accomplished by cutting adjacent edges of the side-by-side envelope blanks with a common die and along a single cut. Since the sealing flaps of the blanks must face in the same direction in an envelope machine of the type wherein blank cut from a web move essentially continuously through folding and gumming stations, the method of the invention results in side-by-side envelope blanks wherein the side flaps are on the back panel of one blank while they are on the front panel of an adjacent blank or on either alternately.

4 Claims, 5 Drawing Figures

ENVELOPE-MAKING METHOD

BACKGROUND OF THE INVENTION

In the manufacture of envelopes, blanks can be cut from paper stock and formed into a pile. Thereafter, successive ones of the blanks from the pile are fed into an envelope-making machine where they are gummed and folded into completed envelopes. In copending application Ser. No. 547,988, filed Feb. 7, 1975 and assigned to the Assignee of the present application, rotary die cutting apparatus is described wherein multiple dies on a rotary cutting drum are provided with each pair of adjoining dies having a common side forming a single cut between them. In this manner, scrap is reduced to a minimum since, in the cutting operation, the side flap of one envelope is in-line with the side flap of an adjacent envelope along the direction of movement of the web from which the blanks are cut.

One disadvantage of the apparatus shown in the aforesaid copending application, however, is that the sealing flap of one adjacent envelope blank faces in a direction opposite that of the adjacent blank. As a result, the die cutting apparatus shown in the aforesaid copending application requires that one-half of the blanks be reversed and that all blanks be formed into a pile before they are fed into an envelope-making machine.

Instead of feeding blanks one-by-one into an envelope-making machine from a stack of such blanks, it is also possible to cut the blanks from a continuously moving web. After being cut from the web, the blanks are fed, without stopping and without having to be formed into a stack, into the gumming and folding portions of the envelope-making machine. This, however, requires that all of the sealing flaps of the envelopes point in the same direction along the direction of movement of the web, meaning that the apparatus shown in the aforesaid copending application is unsatisfactory for this purpose.

SUMMARY OF THE INVENTION

In accordance with the present invention, a new and improved method for making envelopes is provided wherein a continuous web of paper is fed into one end of the envelope-making machine, and blanks are cut from the web and continuously fed into the gumming and folding portions of the machine without the necessity for stacking. The method of the invention is such that scrap losses are minimized and the width of the paper web for a given envelope size is also minimized.

In carrying out the invention, a continuous web of paper is passed through at least one rotating die roll and a back-up anvil roll to sever from the web at least two envelope blanks in side-by-side relationship with the sealing flaps of the envelope blanks extending in the same direction and with the side flaps of one adjacent envelope being on the back panel of the blank while the side flaps of the other adjacent envelope are on the front panel of the blank or either alternately. In this manner, it is possible to feed the blanks, after being cut from the paper web, directly and continuously into the gumming and folding portions of the machine. It is also possible to cut, in this manner, three or more adjacent blanks with the flap portions (i.e., back or front panel) being reversed on adjacent pairs of flaps.

The above and other objects and features of the invention will become apparent from the following detailed description taken in connection with the accompanying drawings which form a part of this specification, and in which.

Figure 1:
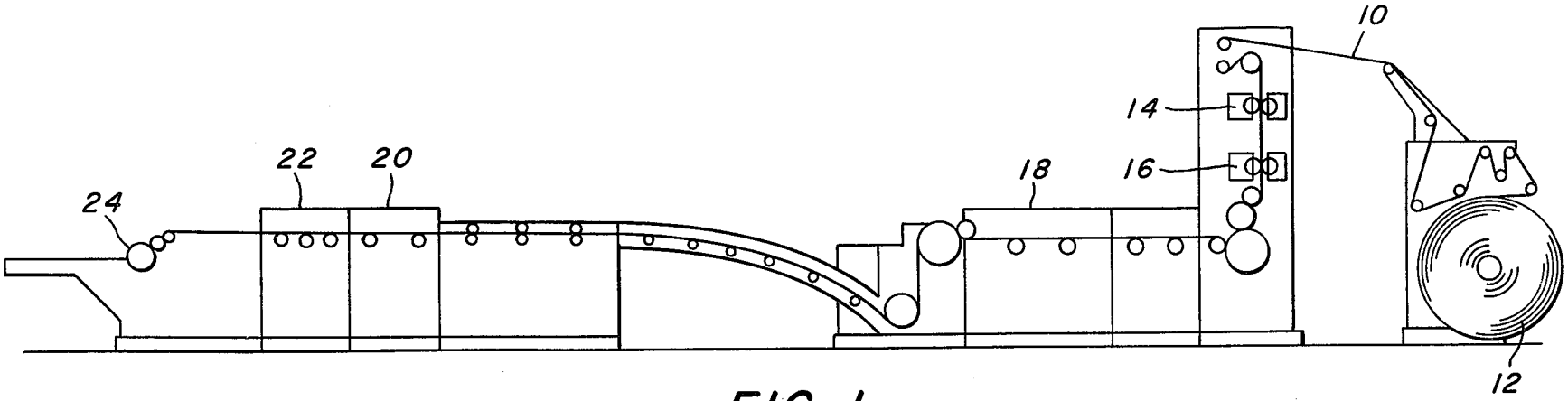
FIG. 1 is a diagrammatic view of one type of envelope-making machine with which the present invention may be used.

With reference now to the drawings, and particularly to FIG. 1, the envelope-making machine shown includes a continuous web of paper 10 which is fed from a roll 12. After passing from the roll 12, the web 10 passes through first and second pairs of rotating die and anvil rolls 14 and 16. After passing through the rotating die and anvil rolls, the blanks are fed to a patching station 18, where an adhesive is applied, and thence through a third and final pair of cutting rolls 20 to folding and forming machinery 22, the formed envelope exiting at 24.

Figure 2:
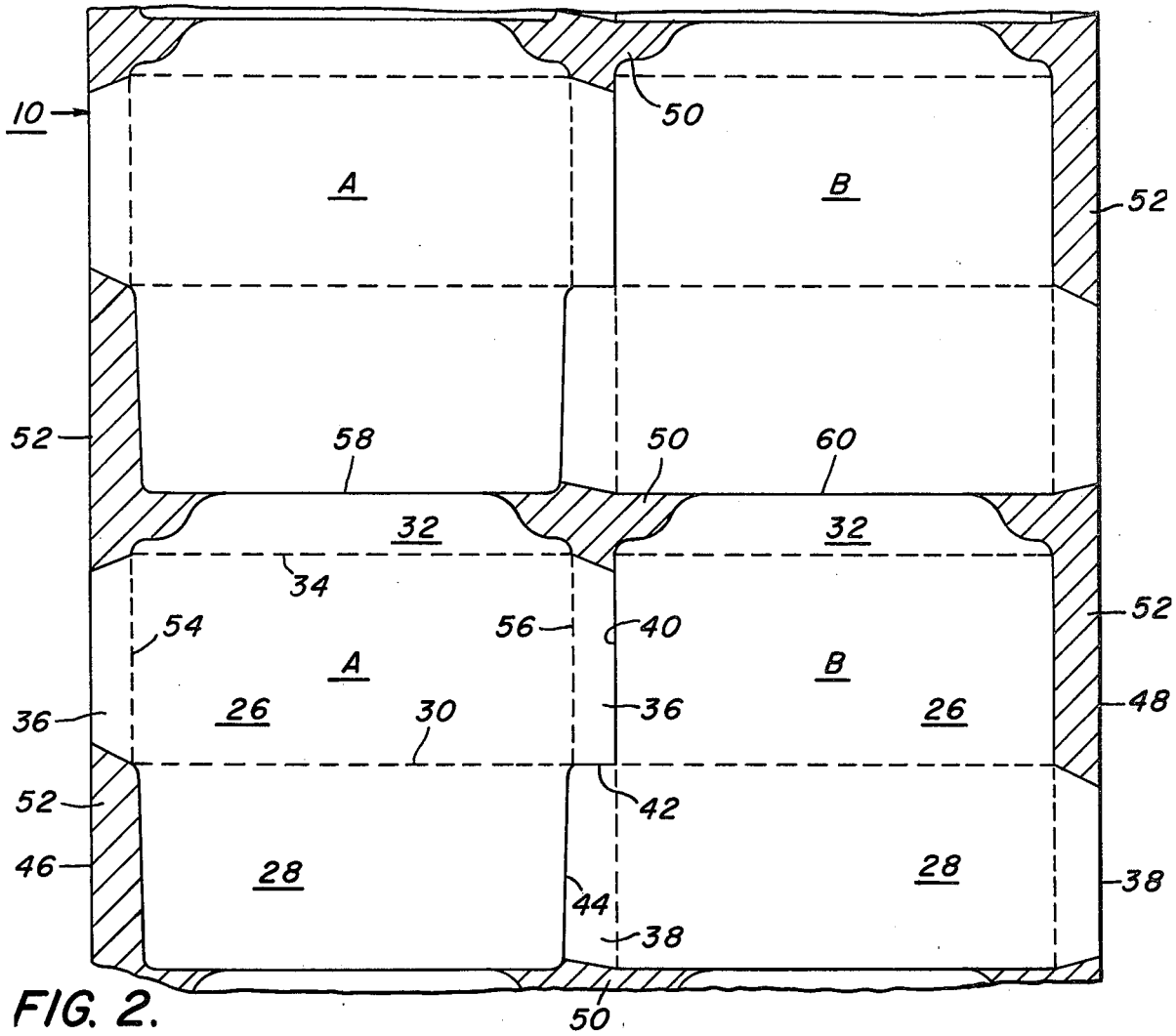
FIG. 2 is an illustration of the continuous web from which envelope blanks are formed in the machine of FIG. 1, showing the manner in which envelope blanks are cut therefrom.

A plan view of the paper web from which the blanks are formed, together with the outline of the blanks themselves, are illustrated in FIG. 2. As can be seen, there are two rows of blanks A and B on the blanks being cut from the web along the full lines shown such that the cross-hatched material constitutes scrap. The broken lines of FIG. 2 illustrate those lines which are scored by the envelope-making machine prior to the folding operation.

Each envelope blank comprises a front panel 26 and a back panel 28, the front and back panels being connected along a scored line 30. A sealing flap 32 is connected to the upper edge of the front panel 26 along a scored line 34. As thus far described, the envelope blanks in rows A and B are the same. However, it will be noted that the blanks in row A carry side flaps 36 on the front panel 26; whereas the blanks in row B have side flaps 38 on the rear panel 28. This facilitates having the inner flap 38, for example, directly behind the inner flap 36, the flaps being formed simultaneously by the cuts 40, 42, and 44 by a single, common cutting die. As will be appreciated, this minimizes the scrap which is generated between the edges 46 and 48 of the web 10. At the same time, the sealing flaps 32 extend in the same direction in order that the blanks can be fed into the continuous envelope-forming machine of FIG. 1.

Figure 3B:
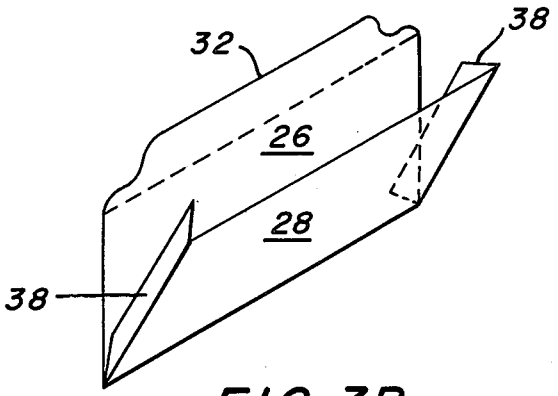
FIGS. 3A and 3B show the envelopes which are formed from the blanks of FIG. 2.
Figure 3A:
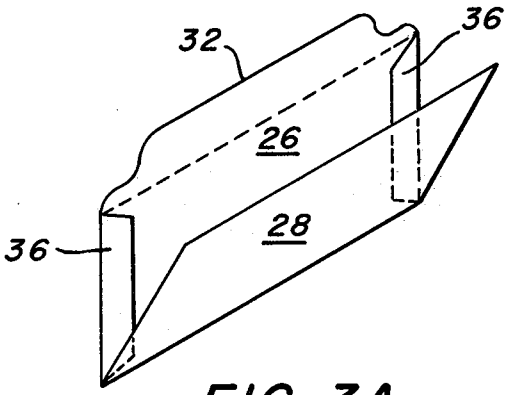

FIG. 3A is an illustration of a partly-folded envelope formed from a blank in row A of FIG. 2; whereas FIG. 3B illustrates a partly-folded envelope formed from a blank in row B of FIG. 2. Note that in the case of FIG. 3A, the side flaps 36 are on the front panel 26 and must be gummed from below in order that the back panel 28 can be folded over them. On the other hand, the flaps 38 in FIG. 3B are on the back panel 28 but again are gummed from below. Thus, both configurations can be spotted with the same roll.

In passing through the envelope-making machine of FIG. 1, the shaded areas 50 and 52 are first cut away in passing through rotary die and anvil rolls 14. In the next operation, successive, adjacent side-by-side blanks are cut from the remainder of the web along lines 58 and 60. This is accomplished in passing through rotating die and anvil rolls 16. Next, the envelope blanks are scored along lines 30 and 34 as well as along lines 54 and 56 which abut the edge flaps 36 and 38. Finally, at cutting roll station 20, the side-by-side blanks are severed by cutting along lines 40, 42, and 44.

Figure 4:
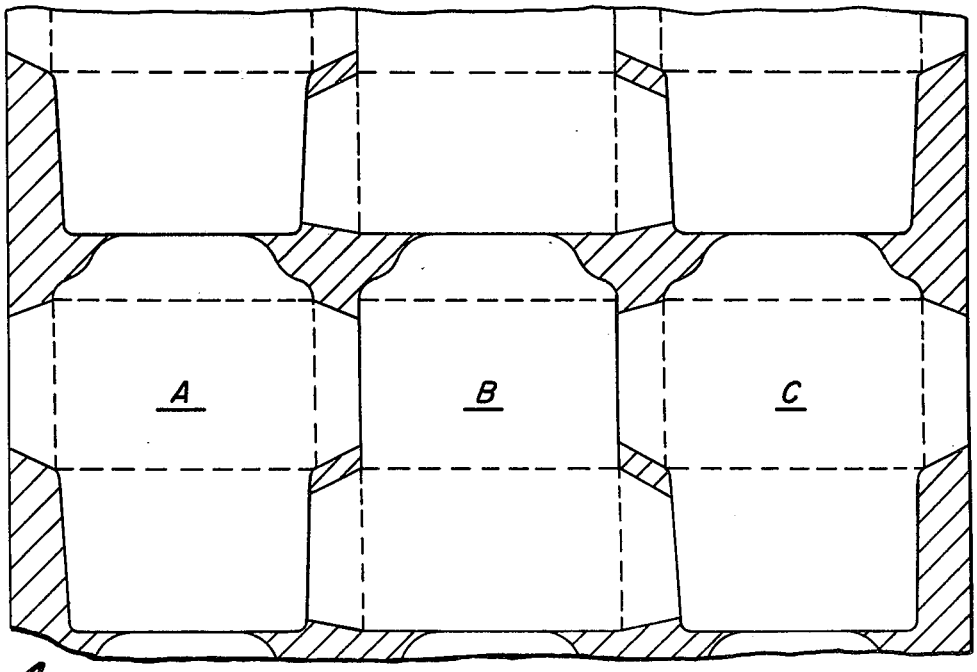
FIG. 4 illustrates another embodiment of the invention, showing the manner in which three or more envelope blanks are cut from a web.

In FIG. 4, another embodiment of the invention is shown wherein three rows of envelope blanks A, B, and C are formed from a single web. In this case, the operation is the same as that of FIG. 1 with the cut-away portions being shown by cross-hatched areas. Again, the sealing flaps of the envelope blanks all point in the same direction and their side flaps overlap with the side flaps of one row B being on the back panel while the adjoining rows A and C have flaps on the front panel.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A method for making envelopes from a continuous web of paper such that the cut blanks can move essentially continuously from one or more cutting stations to envelope-gumming and folding stations, which comprises passing said continuous web through at least one rotating die roll and a back-up anvil roll to sever from the web at least two envelope blanks in side-by-side relationship with the sealing flaps of the envelope blanks extending in the same direction and with the side flaps of one adjacent envelope being on the back panel of the blank while the side flaps of the other adjacent envelope are on the front panel of the blank.

2. The method of claim 1 wherein the facing side flaps of adjacent envelope blanks are formed by a single cutting die which forms a single cut between the blanks.

3. The method of claim 1 wherein said blanks are formed by passing them in succession through at least one set of rotating die rolls and back-up anvil rolls each of which form part of the envelope blanks.

4. The method of claim 1 wherein the cut between adjacent blanks is formed by offset, parallel scores interconnected at their ends by a score which is perpendicular to the first pair of scores.

* * * * *